US006116175A

United States Patent [19]

Ito

[11] Patent Number: 6,116,175

[45] Date of Patent: Sep. 12, 2000

[54] METHOD FOR SEWING STRETCHABLE CLOTHS

[76] Inventor: Mitsuru Ito, 4-8-15-#604 Minami Aoyama, Minato-ku, Tokyo 107, Japan

[21] Appl. No.: 08/978,486

[22] Filed: Nov. 25, 1997

[30] Foreign Application Priority Data

Feb. 10, 1997 [JP] Japan ..... 9-026634
Nov. 12, 1997 [JP] Japan ..... 9-310802

[51] Int. Cl.[7] ..... D05B 1/18

[52] U.S. Cl. ..... 112/475.06; 112/475.09

[58] Field of Search ..... 112/475.06, 475.09, 112/475.14, 475.16, 406, 413, 418, 423–426, 428, 438, 441

[56] References Cited

U.S. PATENT DOCUMENTS

| | | | |
|---|---|---|---|
| 1,467,626 | 9/1923 | Tucker | 112/417 |
| 1,637,540 | 8/1927 | Sukrow | 112/423 X |
| 2,143,381 | 1/1939 | Lind | 112/423 |
| 2,601,035 | 6/1952 | Liebowitz | 112/441 Z |
| 3,333,280 | 8/1967 | Hynek et al. | 112/475.09 X |
| 4,324,004 | 4/1982 | Smith et al. | 112/475.09 X |
| 5,579,709 | 12/1996 | Itoh | 112/475.09 |

*Primary Examiner*—Ismael Izaguirre
*Attorney, Agent, or Firm*—Kanesaka & Takeuchi

[57] ABSTRACT

In a method of sewing stretchable cloths, one or two stretchable cloths and a stretchable base cloth operating as a supporting member are laminated together such that edges of the cloths and the base cloth are aligned, and first stitches are applied at the edge portions of the one or two cloths and the base cloth along the edges. Then, the one or two cloths and the base cloth are folded back along the first stitches to sandwich the edge portions therebetween. Thereafter, second stitches as retaining stitches are applied between the one or two cloths and the base cloth along and outside the edge portions so that the second stitches are formed with stretchability and/or stably. It is possible to make shirts, formal suits as well as business suits without forming bulky, rugged or wrinkly portions while maintaining their original shapes.

12 Claims, 10 Drawing Sheets

METHOD FOR SEWING STRETCHABLE CLOTHS

BACKGROUND OF THE INVENTION AND RELATED ART STATEMENT

The invention relates to a method for sewing stretchable cloths.

There has been known a method disclosed in, for example, U.S. Pat. No. 5,579,709 and Japanese Patent Publication (KOKAI) No. 8-299627, wherein a stretchable cloth woven from spandex, i.e. stretchable thread, such as LYCRA (trade name, made by E. I. Du Pont de Nemours & Co.), which is hereinafter referred to as "LYCRA cloth", and a stretchable cloth made from a knit fabric, such as POLATEC (trade name, made by Malden Company), which is generally called as fleece and is hereinafter referred to as "fleece cloth", are sewn together, as shown in FIGS. 11(*a*) to 11(*c*). First, two cloths 90, 91 are laminated together to be aligned at edges thereof such that the sides which become inner sides when stitching is completed orient outwardly, i.e. sides which become outer sides when stitch is completed face each other. Next, first stitches, i.e. lock machine stitches, 94 are formed at edge portions 92 along edges 93 of the two cloths 90, 91 by a lock stitch machine or interlock stitch machine to thereby stitch together, and the two cloths 90, 91 are folded back outwardly at the first stitches 94 to sandwich or cover the edge portions 92 provided with the first stitches 94 therebetween. Then, while the edges 93 are pushed laterally outwardly, second stitches, i.e. retaining stitches, 95 are formed on the folded-back two cloths 90, 91 along and outside the edges 93 of the edge portions 92 without contacting thereto. According to the conventional sewing method, there is no risk of a puckering in a sewing portion nor threads breaking at the first stitches.

However, in case the stretchable cloths are sewn according to the conventional sewing method, it is difficult to stitch the two cloths since the stretchable cloths are stretchable. Also, since a cloth, such as fleece cloth, has a weak restoring force due to a napping treatment, the cloth deformed by stretching can not be restored to an original state. Further, the sewing portion after completion of sewing become bulky, rugged or wrinkly, so that the sewing portion is not finished neatly. Also, it is especially difficult to make a collar, patch pocket or the like according to the conventional sewing method. In case the collar is formed, lapels made of the stretchable cloths lie down, so that three-dimensional lapels like those formed of non-stretchable cloths and woolen facings or core pieces have not been made. Thus, jackets or parkas for outdoor use are only made from the stretchable cloths, and suits for business and formal uses which require three-dimensional lapels and patch pockets without losing their shapes have not been made from the stretchable cloths.

Therefore, the present invention has been made in view of the above, and an object of the invention is to provide a sewing method of stretchable cloths, wherein suits and jackets for business and formal uses can be made from the stretchable cloths while maintaining stretchability of the cloths in a sewing portion without losing their shapes.

Another object of the invention is to provide a sewing method as stated above, wherein three-dimensional lapels of collar, patch pockets, darts or the like can be made without forming bulky, rugged or wrinkly portions in a sewing area.

A further object of the invention is to provide a sewing method, wherein an edge of a stretchable cloth can be stitched without substantial stretchability.

Further objects and advantages of the invention will be apparent from the following description of the invention.

SUMMARY OF THE INVENTION

The inventor of the present invention has paid attention to a point that a building has a base and a frame to maintain its shape and increase its strength so that a service life can be lengthened. Thus, the inventor thought that if something corresponding to the base and frame in the building is added to a sewing portion of clothes, even if a stretchable cloth is used, neatly finished clothes could be made without forming bulky, rugged or wrinkly portions in a sewing area due to stretching of the cloths. In this point, the inventor has been making various trials and failures, and finally arrived to the present invention.

More specifically, in a sewing method of the present invention, in case two stretchable cloths are stitched together, they are stitched together with a piece of a stretchable cloth made from stretchable threads as a base or frame; in case two stretchable cloths having adhesive core pieces are stitched together, they are sewn together with a piece of stretchable cloth made from stretchable threads as a base or frame; and a stretchable cloth and a piece of stretchable cloth made from stretchable threads as a base or frame are stitched together.

First, two stretchable cloths (hereinafter referred to simply as "cloths") and a piece of stretchable base cloth which is woven from stretchable threads and functions as a base or frame in a sewing portion are laminated together. In this case, the two cloths are laminated and aligned at edges thereof so that the sides of the cloths which become outer surfaces when the stitches are completed face each other. Further, the stretchable base cloth is laminated on or under one of the two cloths to be aligned at one edge with the edges of the two cloths, and first stitches are formed along the edges in the edge portions of the two cloths and the stretchable base cloth by a lock stitch machine or interlock stitch machine to thereby stitch them together.

Next, the laminated two cloths are folded back outwardly along the first stitches to sandwich the edge portions with the first stitches therebetween, so that one of the two cloths embraces the stretchable base cloth therein. Then, second stitches as retaining stitches are formed on the folded-back two cloths and the base cloth along and outside the edges of the edge portions not to contact thereto, so that the two cloths are stitched together. At this time, the stretchable base cloth sandwiched between the two cloths functions as a base or frame in the sewing portion.

In relation to the above sewing method, the two cloths may have stretchable adhesive core pieces and may be stitched together with the stretchable base cloth by the same sewing method as stated above.

Specifically, first, the two cloths with the adhesive inner core pieces thereon are laminated together to be aligned at edges thereof so that the adhesive inner core pieces on the cloths face outwardly. Then, a stretchable base cloth is placed on or under one of the laminated two cloths with the adhesive inner core pieces so that the edge of the base cloth is aligned with the edges of two cloths with the adhesive inner core pieces. Thereafter, first stitches are formed along the edges of the two cloths with the adhesive inner core pieces and the stretchable base cloth by a lock stitch machine or interlock stitch machine to thereby stitch the edge portions together.

Next, the two laminated cloths with the adhesive inner core pieces and the stretchable base cloth are folded back outwardly along the first stitches to sandwich the edge portions provided with the first stitches therebetween so that one of the laminated two cloths with the adhesive inner core pieces embraces the stretchable base cloth therein. Then, second stitches as retaining stitches are formed on the two cloths with the adhesive inner core pieces, so that the two cloths with the adhesive inner core pieces are stitched together along and outside the edges without contacting thereto. In this case, the stretchable base cloth sandwiched between the two cloths functions as a base or frame in the sewing portion.

Also, the present invention provides a sewing method for connecting two cloths by using two cloths and a stretchable base cloth.

Specifically, first, the two cloths and the stretchable base cloth are laminated together. In this case, the two cloths are laminated together to be aligned at edges so that the outer sides of the two cloths face each other. Then, a stretchable base cloth is laminated on or under the two cloths to be aligned at an edge with the edges of the two cloths. Next, first stitches are formed along the edges of the two cloths and the stretchable base cloth by a lock stitch machine or interlock stitch machine to thereby stitch the edge portions of the laminated two cloths and the stretchable base cloth together. Thereafter, one of the laminated two cloths which does not contact the stretchable base cloth and the stretchable base cloth are folded back outwardly along the first stitches to sandwich the edge portions provided with the first stitches therebetween. Then, second stitches are formed as retaining stitches on the folded-back cloth and the folded-back stretchable base cloth by using a zipper foot, i.e. pressure foot, to push the edge portions outwardly, so that the folded-back cloth and the stretchable base cloth piece are stitched together along and outside the edges.

In this case, the stretchable base cloth piece also functions as a base or frame to reinforce the connecting portion of the two cloths.

In addition to the above, the present invention further provides a sewing method where a cloth and a stretchable base cloth are stitched together.

Specifically, first, the stretchable base cloth is laminated on an outer side of the cloth so that the edges are aligned with each other. Thereafter, first stitches are formed along edge portions of the cloth and the stretchable base cloth by a lock stitch machine or interlock stitch machine to thereby stitch the edge portions together. Then, the cloth and the stretchable base cloth are folded back along the first stitches to sandwich the edge portions therebetween. Next, second stitches as retaining stitches are formed on the folded-back cloth and stretchable base cloth along and outside the edge portions provided with the first stitches by using a zipper foot, i.e. pressure foot, to push the edge portions outwardly, so that the cloth and the stretchable base cloth are stitched together.

In this case, the stretchable base cloth piece functions to maintain a completed shape in the sewing portion.

Further, in the method for sewing stretchable cloths of the invention, a stretchable main cloth and an elongated stretchable base cloth operating as a supporting member may be prepared such that a length of the base cloth is shorter than that of the main cloth. Then, the base cloth is stretched and laminated on the main cloth such that edges of the main cloth and the base cloth are aligned, and first stitches are made at edge portions of the main cloth and the base cloth along the edges. Thereafter, the main cloth and the base cloth are folded together as one unit at least once to sandwich the base cloth between parts of the main cloth to thereby form a folded portion. Then, second stitches as retaining stitches are formed at the folded portion, so that the main cloth does not substantially have stretchability at the folded portion. The folded portion without stretchability is useful for a collar or an edge of a shirt.

In the present invention, in case a collar or the like is made, the stretchable base cloth may be beforehand attached to the cloth by an adhesive, so that the collar can be easily stitched together and a neatly finished shape of the collar can be obtained. However, whether the stretchable base cloth and the cloth are beforehand stitched together depends on a portion to be sewn.

BRIEF DESCRIPTION OF THE DRAWINGS

FIGS. 6(*b*) and 6(*c*) are explanatory perspective views of a shirt and a vest formed of the stretchable cloths according to a sewing method of the invention;

DETAILED DESCRIPTION OF PREFERRED EMBODIMENTS

Hereinunder, sewing methods of the present invention are explained referring to the accompanying drawings.

Figure 1A:
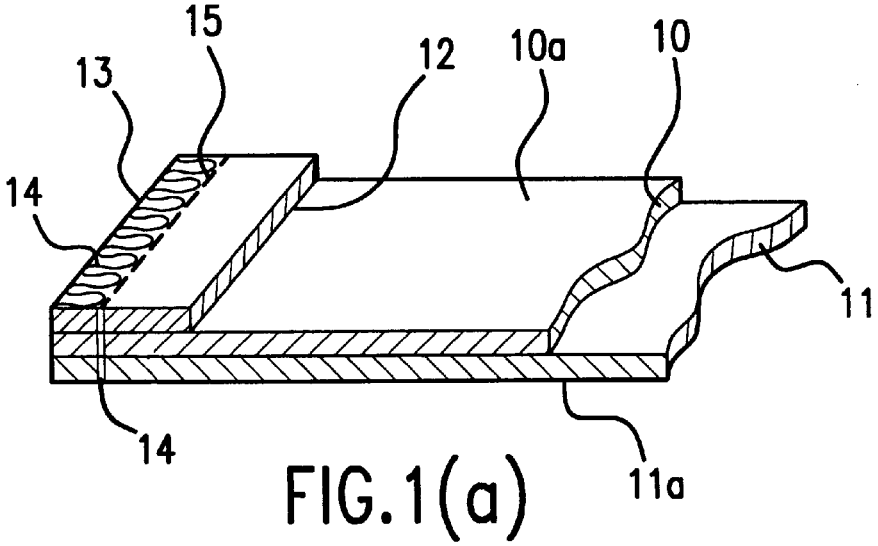
FIGS. 1(*a*)–1(*c*) are perspective sectional views for showing basic steps of sewing two stretchable cloths using a stretchable base cloth.
Figure 1B:
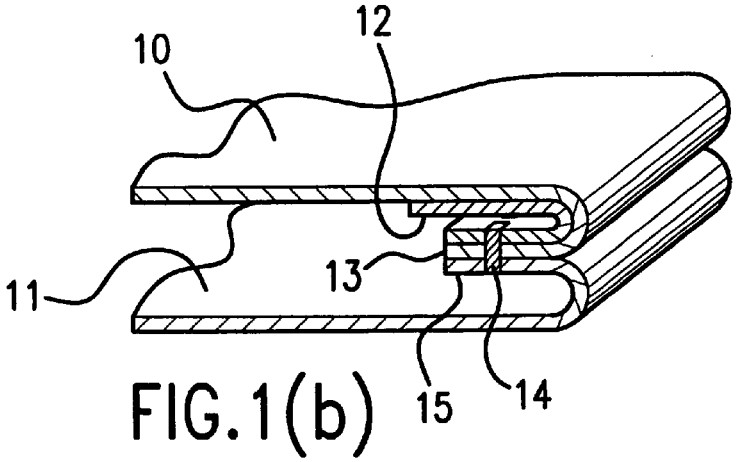
Figure 1C:
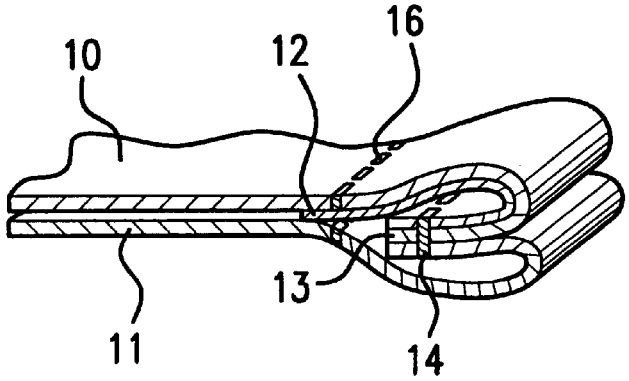

FIGS. 1(*a*) to 1(*c*) show a basic process of a sewing method of the present invention for sewing two stretchable cloths 10, 11 together by using a piece of stretchable base cloth as a base or frame for a sewing portion.

More specifically, first, the stretchable cloths 10, 11 are laminated together to be aligned at edges so that sides 10*a*, 11*a* which become inner sides when the stitching is completed face outwardly. Further, a piece of stretchable base cloth 12 is laminated on or under the laminated two cloths 10, 11 (on the laminated cloth 10 in this case) so that an edge thereof is aligned with the edges of the cloths 10, 11. Then, first stitches 14 are formed in the edge portions 15 along the edges 13 by a lock stitch machine or interlock stitch machine to thereby stitch the edge portions 15 together.

Next, as shown in FIG. 1(*b*), the two laminated cloths 10, 11 are folded back outwardly along the first stitches 14 to sandwich the edge portions 15 therebetween, so that one of the two laminated cloths 10, 11 (cloth 10 in this case) embraces the stretchable base cloth piece 12 therein. At this time, the sides 10*a*, 11*a* of the two cloths as shown in FIG. 1(*a*) face each other.

Then, as shown in FIG. 1(*c*), second stitches as retaining stitches 16 are formed on the two folded-back cloths 10, 11 and the stretchable base cloth piece 12 along and outside the edges 13 of the edge portions 15 without contacting thereto.

When the retaining stitches 16 are formed at the edges of the edge portions, the sewing portion becomes solid so that twists may be formed thereat. Also, if the threads used in the first stitches are caught by the second stitches, the threads may be broken. Thus, in the present invention, the retaining stitches 16 must be formed outside the edges 13 of the edge portions 15 without contacting thereto.

As described above, by adding the stretchable base cloth piece to the sewing portions, the stretchable cloths can be sewn without forming bulky, rugged or wrinkly portions in the sewing area. Also, since the stretchable base cloth piece made from stretchable threads is added to the sewing portions, stable sewing can be made while keeping a good shape. This is due to the stretchable base cloth piece which acts like a reinforcement, for example, an iron reinforced rod in a reinforced concrete building.

Figure 2A:
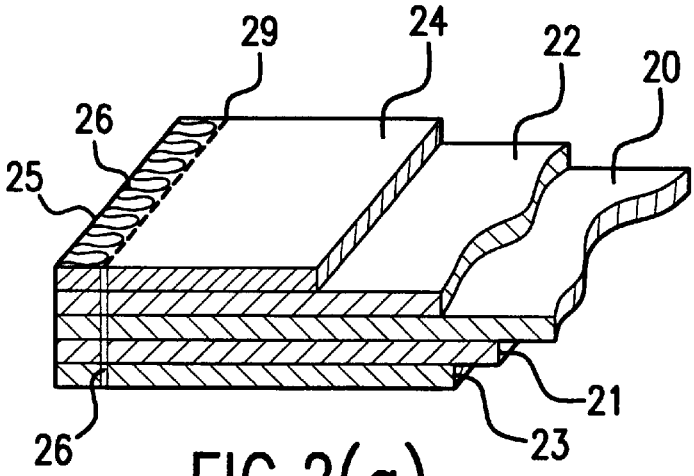
FIGS. 2(*a*)–2(*c*) are perspective sectional views for showing basic steps of sewing two stretchable cloths with core pieces using a stretchable base cloth.
Figure 2B:
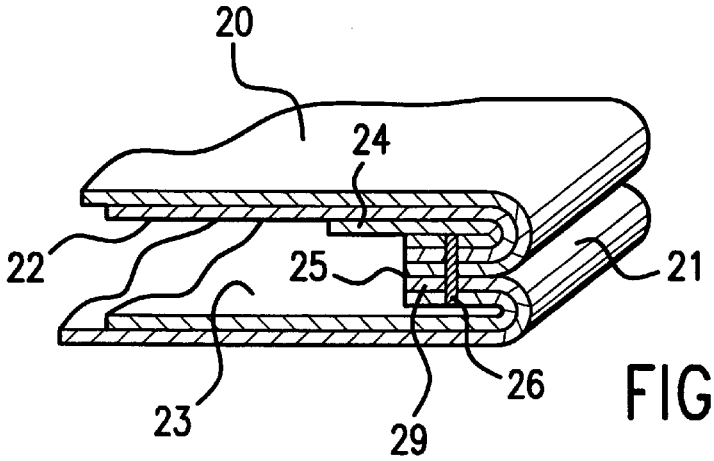
Figure 2C:
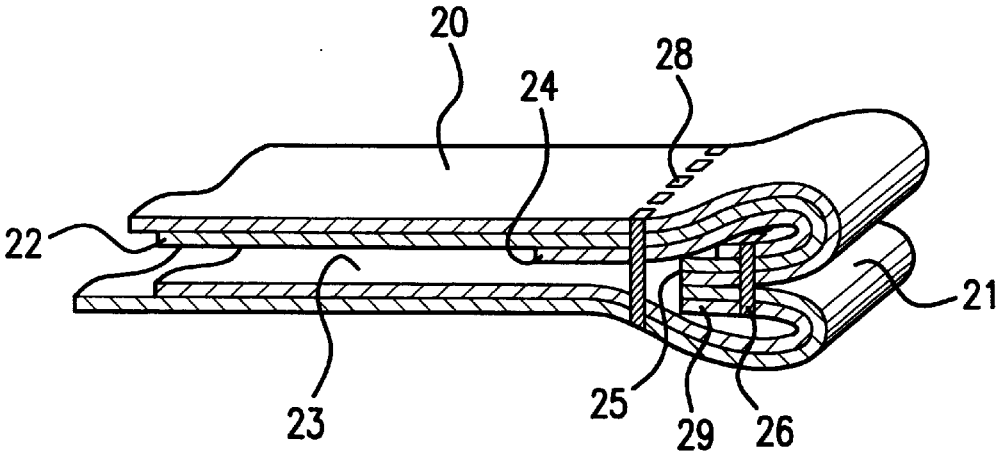

FIGS. 2(*a*) to 2(*c*) show a basic process of a sewing method of the present invention for sewing two stretchable cloths 20, 21 to which adhesive core pieces 22, 23 are previously attached, respectively.

More specifically, as shown in FIG. 2(*a*), first, the adhesive core pieces 22, 23 are previously attached to the sides of the two stretchable cloths 20, 21 which become inner sides when the stitches are completed. Then, the two cloths 20, 21 with the core pieces are laminated and aligned at edges so that the outer sides of the cloths 20, 21 when the stitches are completed face each other. Then, a piece of a stretchable base cloth 24 is laminated on or under the laminated core pieces 22 or 23 (on the core piece 22 in this case) so that an edge thereof is aligned with the edges of the cloths 20, 21 with the core pieces 22, 23. Thereafter, first stitches 26 are formed along the edges 25 of the edge portions 29 of the two cloths with the core pieces 22, 23 and the stretchable base cloth piece 24 by a lock stitch machine or interlock stitch machine to thereby stitch the edge portions 29 together.

Next, as shown in FIG. 2(*b*), the laminated cloths 20, 21 with the core pieces and the stretchable base cloth piece 24 are folded back outwardly along the first stitches 26 to sandwich the edge portions 29 with the first stitches 26 therebetween so that one of the laminated two cloths 20, 21 (cloth 20 in this case) embraces the stretchable base cloth piece 24 therein. At this time, the core pieces 22, 23 attached to the outer sides of the respective two cloths 20, 21 as shown in FIG. 2(*a*) face each other.

Then, as shown in FIG. 2(*c*), second stitches, i.e. retaining stitches, 28 are formed, so that the two cloths 20, 21 with the core pieces are stitched together along and outside the edges 25 of the edge portions 29 without contacting thereto.

In case the retaining stitches 28 are formed near the edges of the edge portions, the sewing portion becomes solid so that twists may be formed thereat. Also, the threads used in the first stitches may be caught by the second stitches, which may break the threads. Thus, in the present invention, the retaining stitches 28 must be formed outside the edges 25 of the edge portions 29 without contacting thereto.

As described above, by sewing the two laminated cloths with the adhesive core pieces together with the stretchable base cloth piece, lapels of a coat or jacket which is made of a fleece cloth can be formed with three-dimensionally expanded curved lines. More specifically, by disposing the stretchable base cloth piece between the two adhesive core pieces, an elastic force can be provided to the stretchable cloths, such as a fleece cloth, having a low elasticity due to a napping treatment. Thus, by the combination of the stretchable base cloth piece and stretchable cloths, such as a fleece cloth, it is possible to form three-dimensionally expanded lapels. As a result, it is possible to produce suits and coats for formal use as well as business use which have not been made according to a conventional method.

Figure 3A:
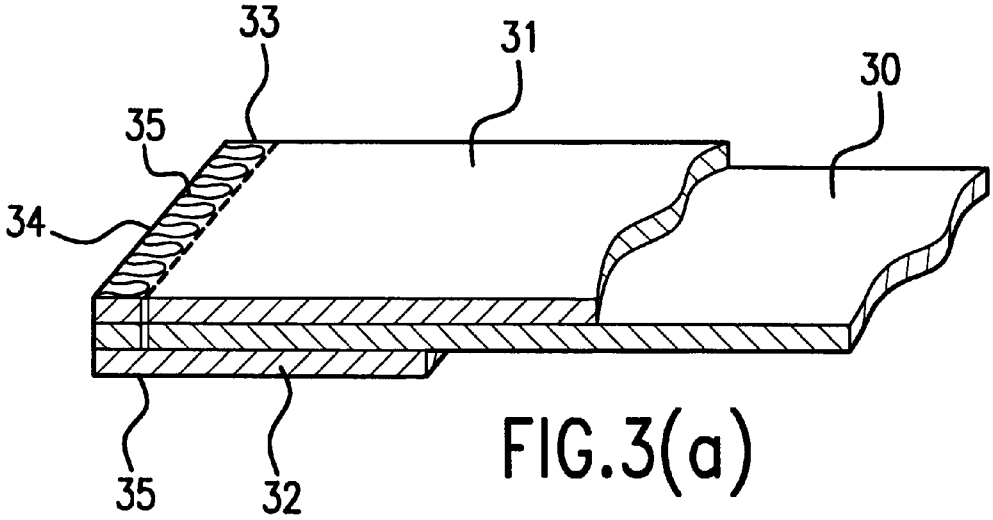
FIGS. 3(*a*)–3(*c*) are perspective sectional views for showing basic steps of connecting two stretchable cloths using a stretchable base cloth.
Figure 3B:
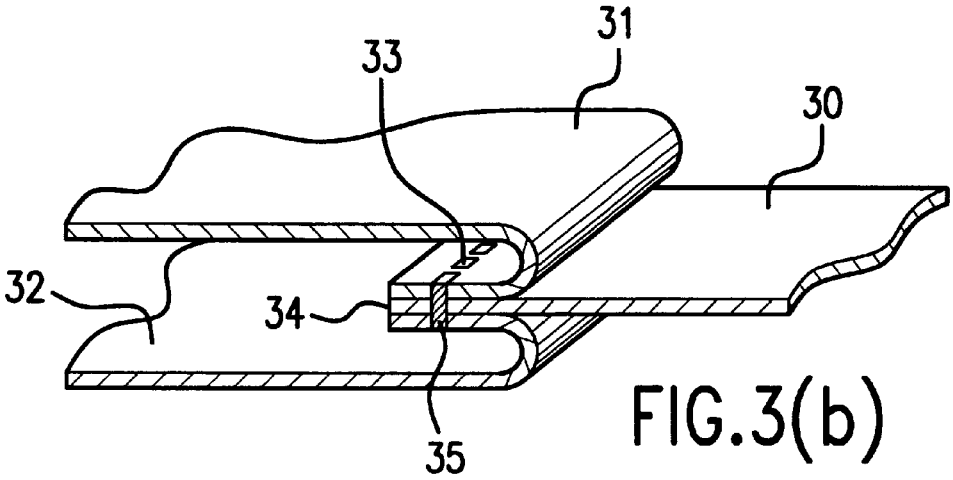
Figure 3C:
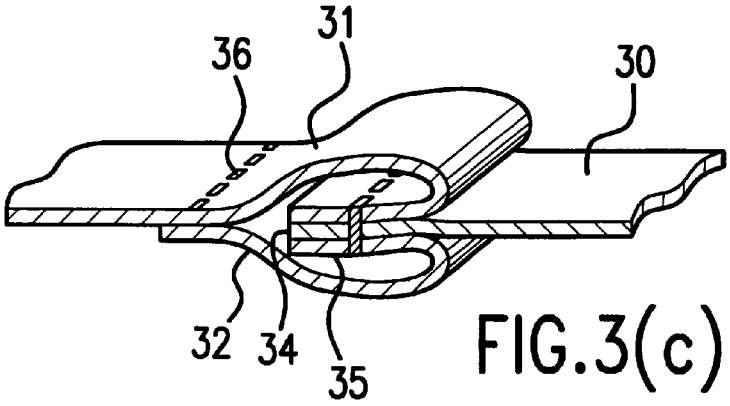

FIGS. 3(*a*) to 3(*c*) show a basic process of another method of the present invention for connecting two cloths.

Specifically, as shown in FIG. 3(*a*), first, two stretchable cloths 30, 31 are laminated together to be aligned at edges thereof so that the sides of the two cloths which become outer sides when the stitches are completed face each other. A piece of stretchable base cloth 32 is laminated under or on one of the two laminated cloths, 30, 31 (under the cloth 30 in this case) to be aligned at an edge with the edges of the two laminated cloths. Then, first stitches 35 are formed along the edges 34 of the edge portions 33 of the laminated two cloths 30, 31 and stretchable base cloth piece 32 by a lock stitch machine or interlock stitch machine to thereby stitch the edge portions 33 of the laminated cloths and the cloth piece 32 together.

Next, as shown in FIG. 3(*b*), one, i.e. the cloth 31 in this example, of the two laminated cloths 30, 31 which does not contact the stretchable base cloth piece 32 and the stretchable base cloth piece 32 are folded back along the first stitches 35 outwardly to sandwich the edge portions 33 with the first stitches 35 therebetween.

Then, as shown in FIG. 3(*c*), second stitches 36 as retaining stitches are formed on the folded back cloth 31 and the stretchable base cloth piece 32 along and outside the edges 34 of the edge portions 33 without contacting thereto by using a zipper foot, i.e. pressure foot, to push the edges 34 outwardly to thereby stitch the two cloths together.

Figure 4A:
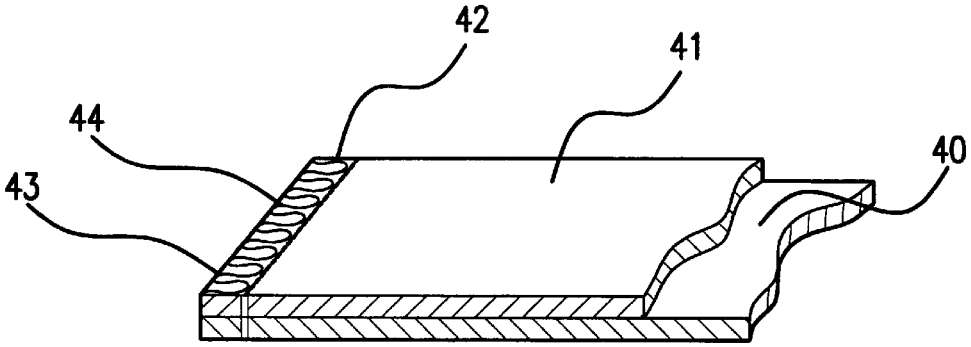
FIGS. 4(*a*)–4(*c*) are perspective sectional views for showing basic steps of sewing a stretchable cloth and a stretchable base cloth.
Figure 4B:
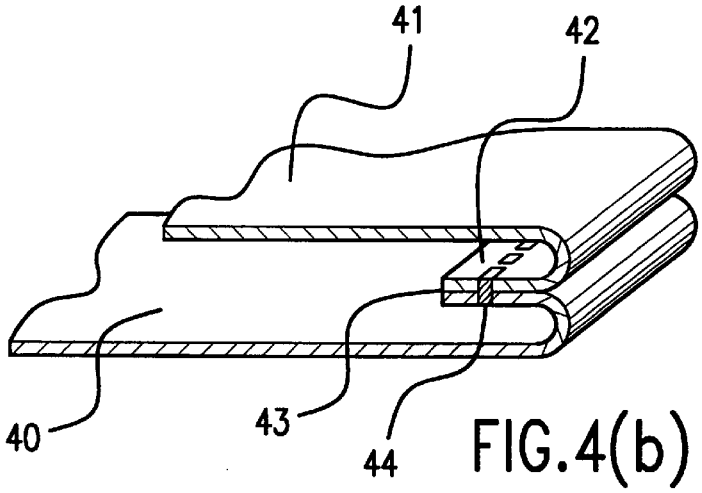
Figure 4C:
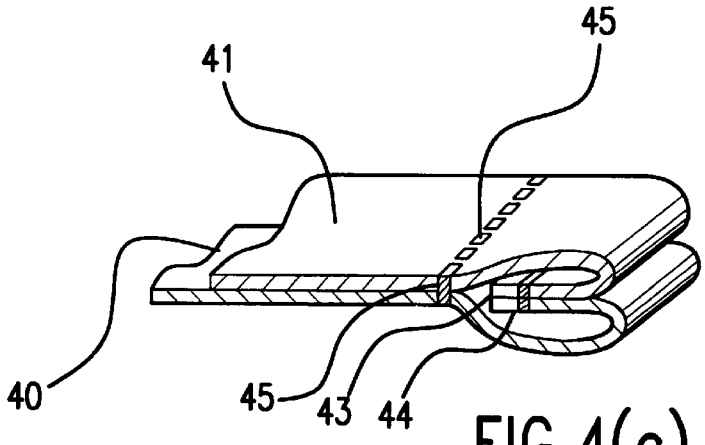
Figure 5A:
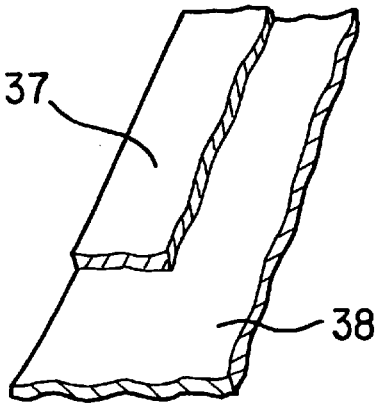
FIGS. 5(*a*)–5(*d*) are perspective views for showing basic steps of sewing an edge of a stretchable cloth and a stretchable base cloth.
Figure 5B:
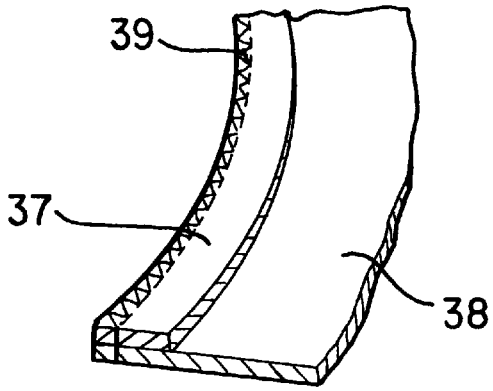
Figure 5C:
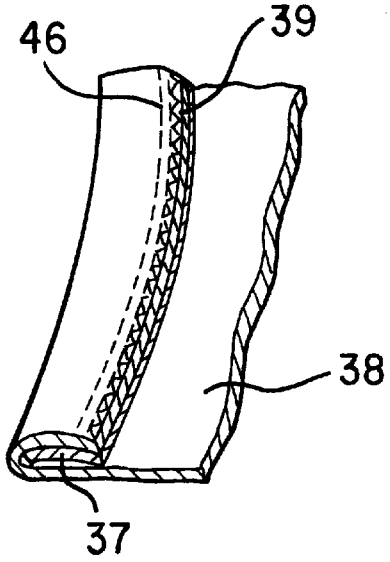
Figure 5D:
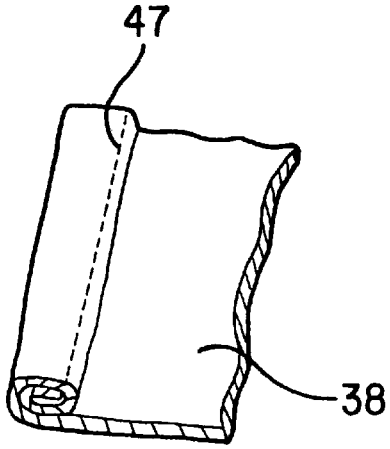

FIGS. 4(*a*) to 4(*c*) show a basic process for making a pocket or the like according to a sewing method of the present invention.

As shown in FIGS. 4(*a*) and 4(*b*), a cloth 40 is disposed such that a side of the cloth 40 which becomes an outer side when the stitches are completed faces upwardly. Then, a stretchable base cloth piece 41 is laminated on the outer side of the cloth 40 to be aligned at edges. Thereafter, first stitches 44 are formed along the edges 43 of the edge portions 42 of the cloth 40 and the stretchable base cloth piece 41 by a lock stitch machine or interlock stitch machine to thereby stitch the edge portions 42 together. Then, the cloth 40 and the stretchable base cloth piece 41 are folded back along the first stitches 44 to sandwich the edge portions 42 therebetween.

Next, as shown in FIG. 4(*c*), second stitches, as retaining stitches, 45 are formed on the cloth 40 and the stretchable base cloth piece 41 along and outside the edges 43 of the edge portions 42 without contacting thereto by using a zipper foot, i.e. pressure foot, to push the edges 43 outwardly to thereby stitch the cloth and the stretchable base cloth piece together.

In the conventional sewing method, it has been difficult to make a patch pocket or the like while keeping its shape because of a stretchable cloth. However, according to the sewing method of the invention, it is possible to make a patch pocket without losing its shape since a base form of the pocket can be made.

FIGS. 5(*a*)–5(*d*) are explanatory perspective views for showing a sewing method at an edge portion of a stretchable cloth to restrict substantial stretchability of the stretchable cloth at the edge portion. This stretchable cloth sewed in this method is useful for connecting a collar or a cuff formed of a stretchable cloth to a body or a main portion formed of the stretchable cloth.

As shown in FIG. 5(*a*), a stretchable base cloth piece 37 is cut for a length shorter than a length of a stretchable main cloth 38 to be attached, e.g. ⅓ to ¼ shorter. The base cloth piece 37 is stretched to the length of the main cloth 38, and is arranged such that the edges of the cloths 37, 38 align together. While the base cloth piece 37 is in a stretched condition, first stitches 39 are formed along the edges of the base cloth piece 37 and the main cloth 38 by a lock stitch machine or interlock stitch machine (FIG. 5(*b*)). Thereafter, the edge portions of the cloths 37, 38 are folded to enclose the base cloth piece 37 inside a part of the main cloth 38. The base cloth piece 37 may be slightly folded. In this condition, second stitches 46 are applied onto the folded portion inside the first stitches 39 to firmly connect the folded portion (FIG. 5(*c*)). On the other hand, after the edge portions are folded twice, second stitches 47 may be applied to the double folded portion (FIG. 5(*d*)).

When a stretching force for the cloths 37, 38 is removed after the first stitches 39 are applied, the edges of the cloths 37, 38 slightly shrink. However, when the edge portions are folded once or twice and the second stitches 46 or 47 are applied to the folded portion, the folded portion with the second stitches 46 or 47 does not substantially change the length. Therefore, the stretchable main cloth 38 can have a relatively stable edge, which is suitable for forming the collar or cuff by the stretchable main cloth 38, or treating an outer edge of the main cloth, or simply connecting the stretchable cloths together.

Figure 6A:
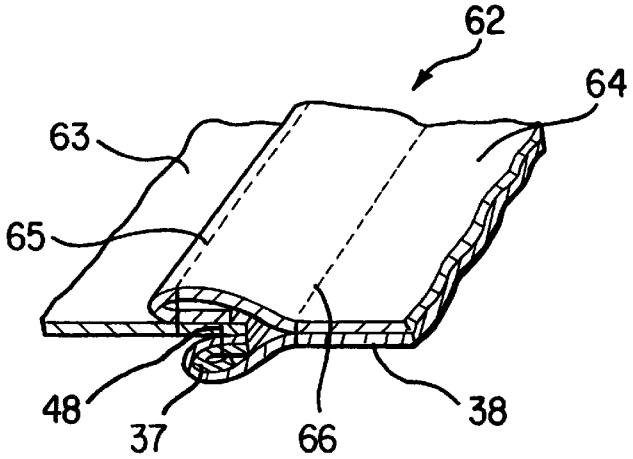
FIG. 6(*a*) is a perspective view for showing a connection of the edge of the stretchable cloth with the stretchable base cloth as shown in FIG. 5(*c*) to other stretchable cloths.
Figure 6B:
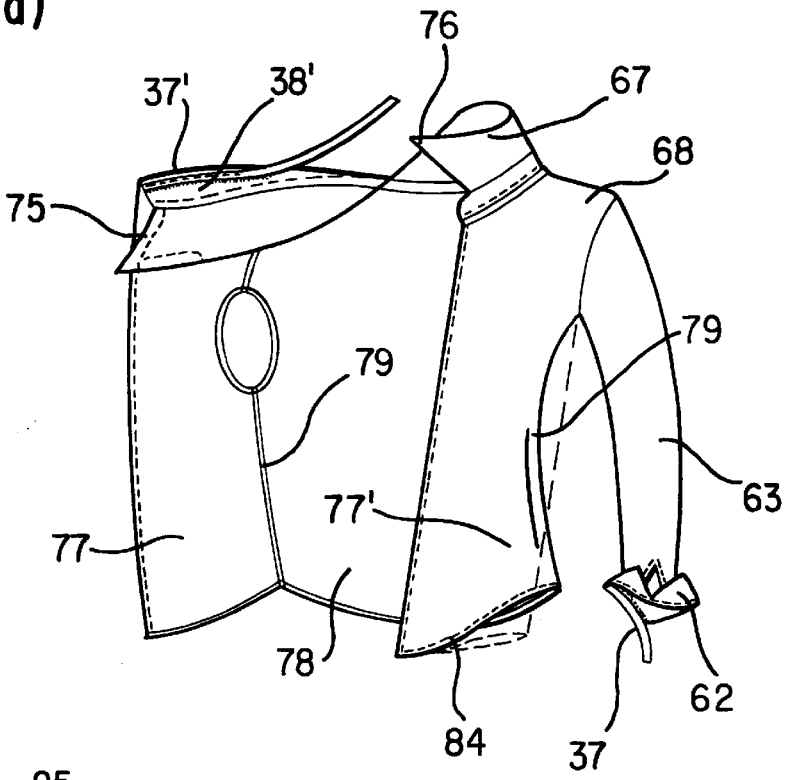
Figure 6C:
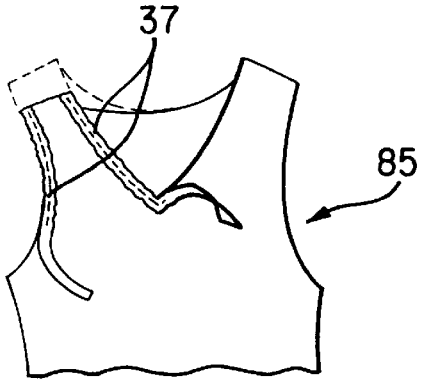

FIG. 6(*a*) shows an example for connecting a cuff 62 to a sleeve 63, both being formed of stretchable cloths. The cuff 62 includes the cloth 38 prepared in the form as shown in FIG. 5(*b*), and a cloth 64. The cloth 38 in the form as shown in FIG. 5(*b*) is disposed under the sleeve 63 such that the cloth 38 and the sleeve 63 directly contact with each other and the edges thereof are aligned. In this condition, stitches 48 are applied to connect the cloths 37, 38 and the sleeve 63 along the edges thereof, and then, the cloths 37, 38 are turned. Thereafter, the cloth 64 is placed on the cloth 38 and the sleeve 63, and an edge of the cloth 64 is turned and sewn to the sleeve 63 by stitches 65. Also, the cloths 38, 64 are stitched together by stitches 66. The stitches 66 are formed while the folded portions of the cloths 38, 64 are laterally pushed by a zipper foot, as disclosed in U.S. Pat. No. 5,579,709.

In this method, after the cloths 38, 64 are stitched together by the stitches 66, the cloth 64 may be sewn to the sleeve 63. Alternatively, after the cloth 38 in the form as shown in FIG. 5(*b*) is stitched to the cloth 64 by the stitches 66, the sleeve 63 and the cloths 37, 38 are sewn together by the stitches 48; the cloths 37, 38 are turned together with the cloth 64; and then the clothes 63, 64 are sewn together by the stitches 65.

Although the cuff 62 is attached to the sleeve 63 in this method, a collar 67 as shown in FIG. 6(*b*) may be attached to a body portion 68 of a shirt in a similar manner as shown in FIG. 6(*a*). In FIG. 6(*b*), a cloth 38' is sewn to the collar 67, and the cloths 37', 38' and an upper end of a front body 77 are simply overlapped and sewn together. A cloth (not shown) fixed to the collar 67 and similar to the cloth 64 is placed over the cloths 37', 38' shown in FIG. 6(*b*) to cover the cloths 37', 38' and the edges thereof, and is sewn to the front body 77 and the cloth 38' similar to the stitches 65, 66. In this case, the collar 67 has an adhesive core piece 75 along an outer edge, and an adhesive core tip 76 inside the collar 67 to keep the shape of the collar 67.

In the shirt as shown in FIG. 6(*b*), the front bodies 77, 77' are connected to a rear body 78. The side edges 79 of the front bodies 77, 77' and the rear body 78 are treated as shown in FIG. 5(*c*), and are connected together. After the side edges are sewn together, the side edges 79 do not excessively expand or shrink, so that the shape of the shirt can be kept as sewn together. Also, the lower edges 84 of the front and rear bodies 77, 77', 78 are treated as shown in FIG. 5(*d*), so that the shape of the lower edges 84 are also kept as it is made. Therefore, even if the shirt is made from the stretchable cloth, the shape can be well maintained.

FIG. 6(*c*) shows a vest 85 formed of a stretchable cloth, which has neck and sleeve portions with stretchable base cloth pieces 37. The neck and sleeve portions may be treated as shown in FIG. 5(*c*), or tapes and the base cloth pieces 37 may be applied to the neck and sleeve portions. Since the edges of the neck and sleeve portions have the base cloth pieces 37, the shape of the edges can be made stably.

As described above, by adding a stretchable base cloth piece, a stretchable cloth, such as a fleece cloth, can be sewn neatly without forming bulky, rugged or wrinkly portions in the sewing area. Also, since a base, i.e. the stretchable base cloth piece, is added to a sewing area, stable sewing can be made without losing its shape. The stretchable base cloth piece operates like a reinforcing member. Thus, a three-dimensionally expanded collar, pocket not losing its shape, dart joint and the like can be made. As a result, it is possible to make suits and coats for formal use as well as business use which have not been made by a conventional method.

As stretchable cloths to which the sewing methods of the invention are applied, in addition to the LYCRA and fleece cloths as mentioned above, a cut-and-sew type cloth, such as a knit fabric, may be included. In case the stretchable cloths are sewn together according to the sewing method of the invention by adding a piece of a stretchable base cloth acting as a base or frame to the stretchable cloths to be stitched together, since a sewing portion is provided with a restoring force, even the stretchable cloth, such as the fleece cloth having a low restoring force due to a napping treatment, can be provided with the restoring force. Thus, the stretchable cloth can be sewn easily and stably without forming bulky, rugged or wrinkly portions in the sewing area.

In the present invention, it is important to use a LYCRA cloth as the stretchable base cloth piece, so that a cloth, such as the fleece cloth which has lost its restoring force, can recover its restoring force, or a cloth which has been stretched out by stitching can restore its shape to an original state to thereby form the sewing area without making the bulky, rugged or wrinkly portions.

EXAMPLE 1

Figure 7A:
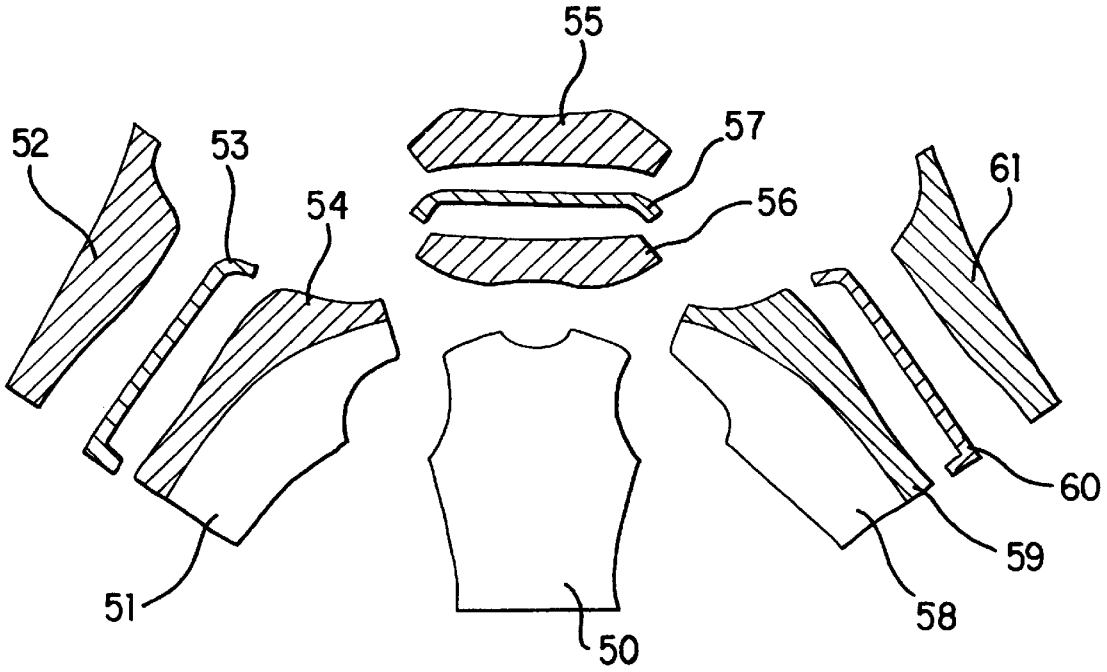
FIGS. 7(*a*) and 7(*b*) are exploded views for showing steps of sewing a jacket according to a sewing method of the present invention.
Figure 7B:
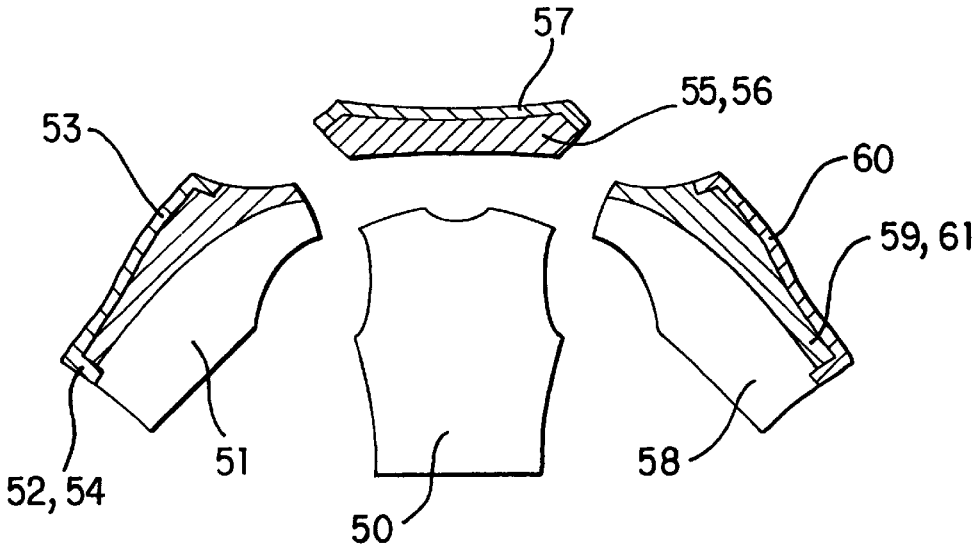

According to a sewing method of the present invention, a jacket for a business suit was made by using stretchable cloths. As shown in FIGS. 7(*a*) and 7(*b*), adhesive core pieces 52, 54, 55, 56, 59, 61, and front and back bodies 50, 51, 58 made of fleece cloths were prepared. The core pieces 52, 61 were laminated with front facings, and the core pieces 54, 59 were laminated with front bodies 51, 58. Also, the core pieces 55, 56 were laminated with parts of a collar formed of a fleece cloth. Then, stretchable base cloth pieces 53, 57, 60 formed of LYCRA cloths were added thereon.

First, each front body and the core piece were made one unit; the front facing and the core piece were made one unit; and the stretchable base cloth piece was added to the two units so that the three units were integrally stitched together into one unit to complete a three dimensional collar, i.e. lapel with the front body. By integrally uniting the three units of the cloths at the front body, the five cloths were properly stitched together, and due to the stretchable base cloth piece sandwiched therebetween the jacket having a three dimensional shape in the collar portion, as shown in FIGS. 8(*a*) and 8(*b*), could be obtained.

The jacket sewn according to the sewing method of the invention had the same appearance as that of a jacket which was made of a non-stretchable cloth and had woolen core pieces at a collar portion.

EXAMPLE 2

Figure 8A:
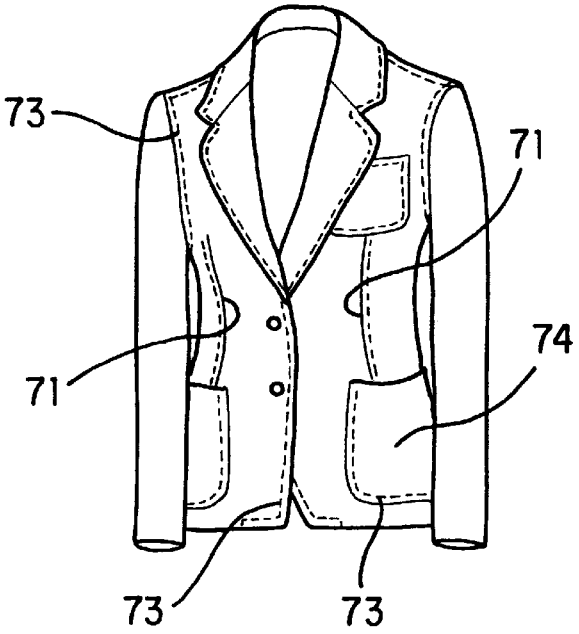
FIGS. 8(*a*) and 8(*b*) are schematic views of front and back sides of a jacket sewn according to a sewing method of the present invention.
Figure 8B:
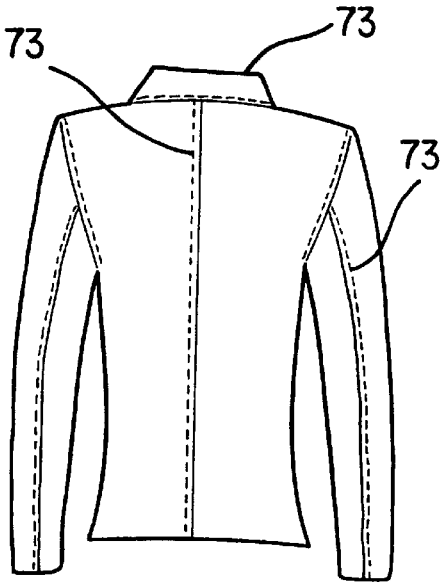

Patch pockets 74 as shown in FIGS. 8(*a*) and 9(*b*) were made from a stretchable cloth by the sewing method of the present invention shown in FIGS. 4(*a*)–4(*c*) and 10(*a*)–10(*d*). As shown in FIGS. 4(*a*) and 10(*a*), a stretchable base cloth piece 41(81), i.e. LYCRA cloth, was laminated on edges of a stretchable cloth 40(80), i.e. fleece cloth, and then first stitches 44(82) were formed along the edges thereof by a lock stitch machine or interlock stitch machine. Then, the stretchable base cloth piece 41(81) and the stretchable cloth 40(80) were folded back along the first stitches 44(82), and second stitches 45(83) were made outside the edges provided with the first stitches 44(82) while laterally pushing the edges, as shown in FIGS. 4(*c*) and 10(*d*). The patch pocket 74 is sewn to a jacket or pants as shown in FIGS. 8(*a*) and 9(*b*). Incidentally, numeral 73 shows the location of the stretchable base cloth piece in the jacket and pants.

The patch pockets obtained according to the sewing method of the invention had a nicely finished appearance without forming bulky, rugged or wrinkly portions.

Figure 9A:
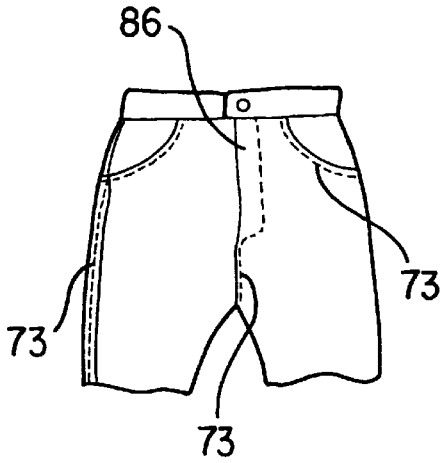
FIGS. 9(*a*) and 9(*b*) are partial schematic views of front and back sides of pants with pockets sewn according to the sewing method of the present invention.
Figure 9B:
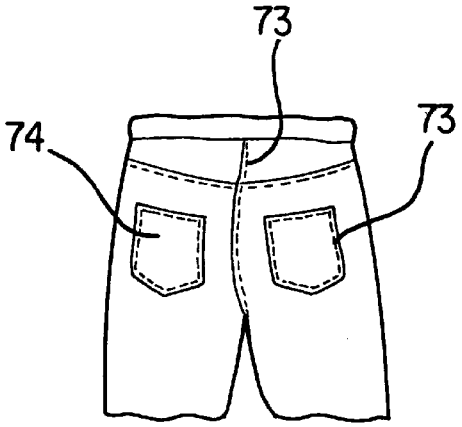
Figure 10A:
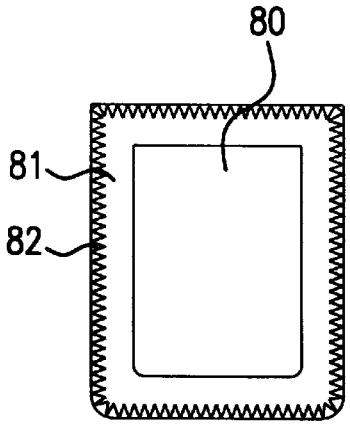
FIGS. 10(*a*)–10(*d*) are explanatory views for showing steps of sewing a patch pocket according to the present invention.
Figure 10B:
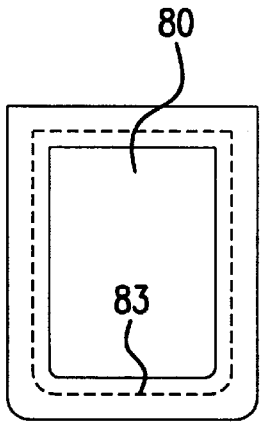
Figure 10C:
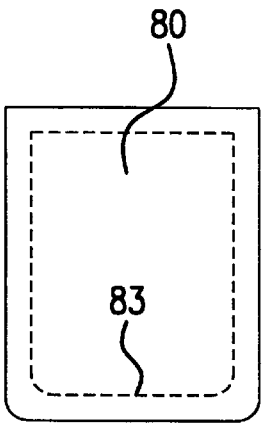
Figure 10D:
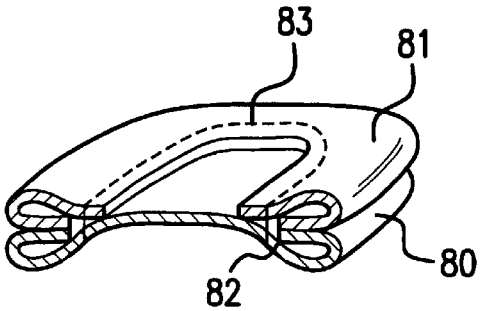
Figure 11A:
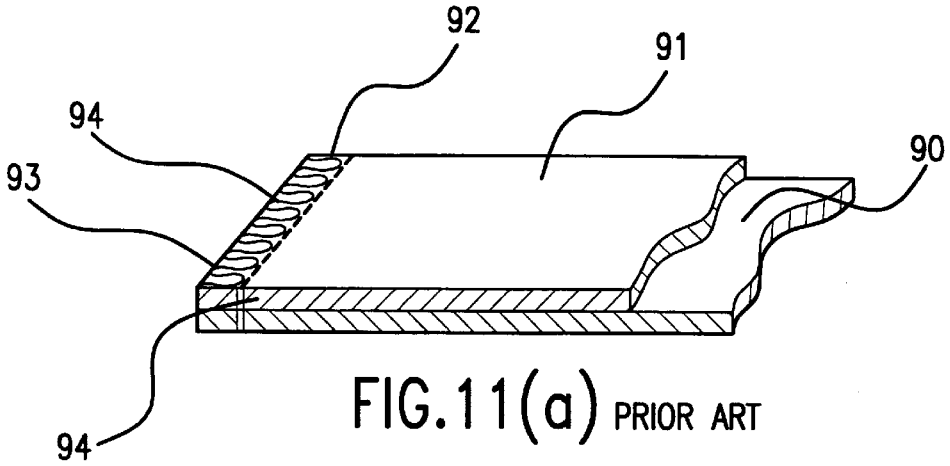
FIG.11(a) PRIOR ART
FIGS. 11(*a*)–11(*c*) are perspective sectional views for showing conventional steps of sewing stretchable cloths.
Figure 11B:
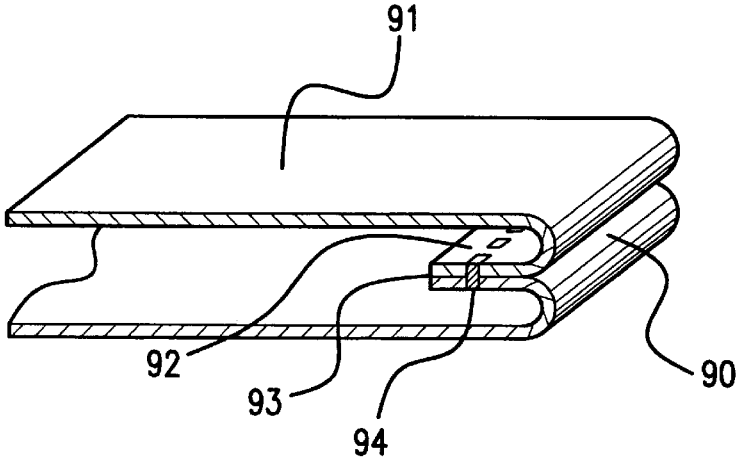
FIG.11(b) PRIOR ART
Figure 11C:
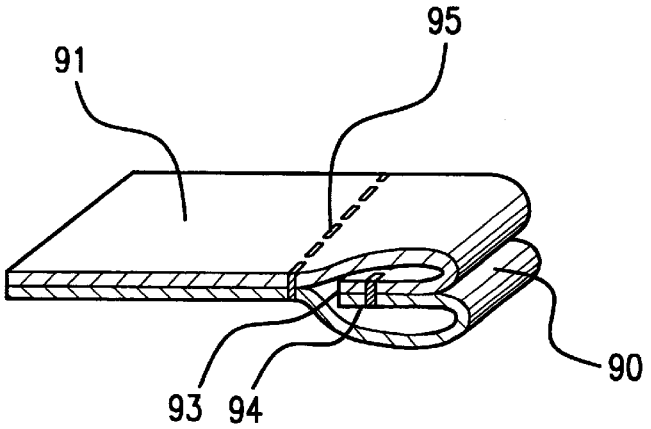
FIG.11(c) PRIOR ART

Also, as shown in FIG. 9(*a*), a zipper 84 may be made of a stretchable cloth, i.e. LYCRA. In this case, the zipper 86 is sewn to the stretchable base cloth piece 37, similar to the embodiment as shown in FIG. 5(*b*), wherein the zipper 86 corresponds to the cloth 37. The zipper 86 is stitched to a main portion of the pants, which corresponds to the cloth 63. Thus, the zipper portion is formed similar to the embodiment as shown in FIG. 6(*a*), from which the cloth 64 is removed.

EXAMPLE 3

Also, according to a sewing method of the invention, darts of a suit made of a stretchable cloth were made. In case darts 71 of the suit as shown in FIG. 8(*a*) were made, the process, as shown in FIGS. 3(*a*) to 3(*c*), which is the sewing method according to the present invention was used. The method can also be used for stitching together arm hole portions, pants, skirts, one-piece dresses or the like.

Clothes having a stable shape and three-dimensional appearance could be made owing to the darts made by the sewing method according to the invention by using the stretchable cloth, such as LYCRA cloth, since bulky, rugged and wrinkly portions were not formed in the sewing area.

In the above examples, since the stretchable base cloth pieces, which function like reinforcing materials, were provided as shown by broken lines 73 in FIGS. 8(*a*), 8(*b*), 9(*a*) and 9(*b*), the three-dimensionally expanded jacket with collar portions and darts portions of the jacket and patch pockets of pants could be obtained without losing their shapes.

According to the present invention, even if collars, patch pockets, darts and the like are made of a stretchable cloth, since the stretchable base cloth piece is added, bulky, rugged and wrinkly portions are not formed in the sewing areas. Also, since three-dimensional lapels and darts can be made, while holding stretchability in the sewing portions, clothes without losing their shapes can be made. Thus, suits and jacket for business and formal use can be made in addition to jackets and parkas for an outdoor use.

Also, a shirt with a collar and cuffs made of a stretchable cloth can be made in accordance with the invention, wherein parts of the collar and cuffs and edges portions can be made stably. Since the parts of a shirt which should have a stable length can be made as desired, the shirt can be made by the stretchable cloth.

What is claimed is:

1. A method for sewing stretchable cloths comprising:

laminating first and second stretchable cloths together such that outer faces of the first and second cloths face each other and edges of the first and second cloths are aligned;

laminating a stretchable base cloth over the first cloth such that an edge of the base cloth is aligned with the edges of the first and second cloths;

providing first stitches at edge portions of the first and second cloths and the base cloth along the edges;

folding back the first cloth with the base cloth thereon and the second cloth along the first stitches to sandwich the base cloth and the edge portions between the first and second cloths so that the outer faces of the first and second cloths face outwardly; and providing second stitches as retaining stitches between the first and second cloths with the base cloth therebetween along and outside the edge portions so that the second stitches are formed smoothly.

2. A method for sewing stretchable cloths according to claim 1, wherein said stretchable base cloth has an elongated shape to operate as a supporting member for the second stitches.

3. A method for sewing stretchable cloths according to claim 2, wherein each of said first and second stretchable cloths has a stretchable adhesive core piece on an inner side thereof.

4. A method for sewing stretchable cloths according to claim 2, further comprising at least one stretchable adhesive core piece fixed to at least a part of the first and second stretchable cloths to provide stability to the cloth.

5. A method for sewing stretchable cloths comprising:

laminating a first stretchable cloth and an elongated stretchable base cloth operating as a supporting member together such that an outer face of the first cloth faces the base cloth and edges of the first cloth and the base cloth are aligned;

providing first stitches at edge portions of the first cloth and the base cloth along the edges;

folding back the first cloth and the base cloth along the first stitches to sandwich the edge portions therebetween; and providing second stitches as retaining stitches between the first cloth and the base cloth along and outside the edge portions while pushing the edge portions away from the second stitches by a foot of a sewing machine so that the second stitches are formed stably.

6. A method for sewing stretchable cloths according to claim 5, further comprising disposing a second stretchable cloth between the first cloth and the base cloth such that an outer face of the second cloth faces the first cloth, said first stitches being applied to connect the first and second cloths and the base cloth.

7. A method for sewing stretchable cloths according to claim 5, wherein said first cloth has a wide area, and said base cloth is fixed to the first cloth around three edges of the first cloth by the first and second stitches, said first cloth with the base cloth being placed over a second cloth and stitched thereto to thereby form a patch pocket.

8. A method for sewing stretchable cloths comprising:

preparing a stretchable main cloth and an elongated stretchable base cloth operating as a supporting member such that a length of the base cloth is shorter than that of the main cloth;

stretching the base cloth and laminating the base cloth on the main cloth such that edges of the main cloth and the base cloth are aligned;

providing first stitches at edge portions of the main cloth and the base cloth along the edges;

laminating a second cloth over the edge portions of the main cloth and the base cloth; and providing second stitches as retaining stitches over the second, main and base cloths so that the main cloth has a stable length.

9. A method for sewing stretchable cloths according to claim 8, wherein said second cloth is formed of portions of the main cloth and the base cloth folded along the edges at least once to sandwich the base cloth between parts of the main cloth to thereby form a folded portion with the second stitches.

10. A method for sewing stretchable cloths according to claim 8, wherein the length of the base cloth when it is prepared is between ⅓ and ¼ of the length of the main cloth.

11. A method for sewing stretchable cloths according to claim 10, further comprising an additional stretchable cloth disposed on the main cloth at a side to form a folded portion, said main cloth and the additional cloth being stitched together at a side along and outside the folded portion.

12. A method for sewing stretchable cloths according to claim 8, wherein said main cloth is a cloth piece of a zipper.

* * * * *